US009865244B2

(12) United States Patent
Hanazono et al.

(10) Patent No.: US 9,865,244 B2
(45) Date of Patent: Jan. 9, 2018

(54) SIGNAL PROCESSING DEVICE, PROGRAM, AND RANGE HOOD SYSTEM

(71) Applicant: Panasonic Intellectual Property Management Co., Ltd., Osaka (JP)

(72) Inventors: Masaya Hanazono, Osaka (JP); Wakio Yamada, Hyogo (JP)

(73) Assignee: Panasonic Intellectual Property Management Co., Ltd., Osaka (JP)

( * ) Notice: Subject to any disclaimer, the term of this patent is extended or adjusted under 35 U.S.C. 154(b) by 0 days.

(21) Appl. No.: 15/122,273

(22) PCT Filed: Feb. 26, 2015

(86) PCT No.: PCT/JP2015/000982
§ 371 (c)(1),
(2) Date: Aug. 29, 2016

(87) PCT Pub. No.: WO2015/133094
PCT Pub. Date: Sep. 11, 2015

(65) Prior Publication Data

US 2016/0372106 A1 Dec. 22, 2016

(30) Foreign Application Priority Data

Mar. 7, 2014 (JP) ..... 2014-045571

(51) Int. Cl.
*G10K 11/178* (2006.01)
*F24F 13/24* (2006.01)
*F24C 15/20* (2006.01)

(52) U.S. Cl.
CPC ..... *G10K 11/1788* (2013.01); *F24C 15/2021* (2013.01); *F24C 15/2042* (2013.01);
(Continued)

(58) Field of Classification Search
CPC ..... H04B 29/00; G10K 2210/00; G10K 2210/232; G10K 2210/3026; G10K 2210/3007; G10K 2210/3018
(Continued)

(56) References Cited

U.S. PATENT DOCUMENTS 5,689,572 A * 11/1997 Ohki ..... G10K 11/1786 381/71.3
5,832,095 A * 11/1998 Daniels ..... G10K 11/1784 381/71.14
(Continued)

FOREIGN PATENT DOCUMENTS

JP 04-282694 A 10/1992
JP 04282694 A * 10/1992
(Continued)

OTHER PUBLICATIONS

International Search Report for corresponding International Application No. PCT/JP2015/000982 dated Jun. 2, 2015.
(Continued)

*Primary Examiner* — Melur Ramakrishnaiah
(74) *Attorney, Agent, or Firm* — Renner, Otto, Boisselle & Sklar, LLP

(57) ABSTRACT

A silencer is to be used in combination with a range hood system to suppress noise made by a fan. In a silencing circuit, a disturbance detector detects mixing of disturbance sound to a correction signal and an error signal. When the disturbance detector detects the mixing of the disturbance sound, an updating stopper causes a coefficient updater to stop a processing of updating a filter coefficient of a silencer filter, relating to, as an object, at least a frequency band other than a frequency band of the noise.

11 Claims, 5 Drawing Sheets

(52) U.S. Cl.
CPC ..... *F24F 13/24* (2013.01); *G10K 11/178* (2013.01); *F24F 2013/247* (2013.01); *G10K 2210/105* (2013.01); *G10K 2210/109* (2013.01); *G10K 2210/112* (2013.01); *G10K 2210/3025* (2013.01); *G10K 2210/3026* (2013.01); *G10K 2210/3028* (2013.01); *G10K 2210/30231* (2013.01)

(58) Field of Classification Search
USPC ..... 381/71.5, 71.6, 71.1, 71.8, 71.9, 71.12, 381/61, 56, 63
See application file for complete search history.

(56) References Cited

U.S. PATENT DOCUMENTS

| | | | | |
|---|---|---|---|---|
| 6,330,336 | B1 | 12/2001 | Kasama | |
| 2004/0240678 | A1* | 12/2004 | Nakamura ..... | G10K 11/1784 381/71.11 |

FOREIGN PATENT DOCUMENTS

| | | | | |
|---|---|---|---|---|
| JP | 06-118971 | A | | 4/1994 |
| JP | 06-348284 | A | | 12/1994 |
| JP | 08-248964 | A | | 9/1996 |
| JP | 08248964 | A | * | 9/1996 |
| JP | 10-171465 | A | | 6/1998 |
| JP | 10-187201 | A | | 7/1998 |
| JP | 10187201 | A | * | 7/1998 |
| JP | 2009-113659 | A | | 5/2009 |

OTHER PUBLICATIONS

Form PCT/ISA/237 for corresponding International Application No. PCT/JP2015/000982 dated Jun. 2, 2015.

* cited by examiner

SIGNAL PROCESSING DEVICE, PROGRAM, AND RANGE HOOD SYSTEM

TECHNICAL FIELD

This invention relates generally to signal processing devices, programs, and range hood systems and, more particularly, to a signal processing device, a program and a range hood system, which utilize active noise control.

BACKGROUND ART

There has been conventionally a silencer using active noise control, as a technique for reducing noise in an object space where sound made by a noise source is propagated (a noise propagation path). The active noise control is a technique to actively reduce the noise by emitting a canceling sound with the reverse phase and the same amplitude relative to the noise.

The active noise control is to execute a silencing program that realizes a function of an adaptive filter in order to follow up a change in the noise made by the noise source or a change in the noise propagation characteristics. However, in case there is external sound (disturbance sound) other than the noise, which is the sound to be silenced, made by the noise source, the disturbance sound may cause a filter coefficient of the adaptive filter to diverge. As a result of divergence of the filter coefficient, an effect of canceling the noise may be reduced, and further, the canceling sound itself emitted by the silencer may become noise.

To solve this issue, there has been proposed a silencer that, when abnormity such as the disturbance sound is detected, resets parameters such as a transfer function and a convergence coefficient which are to be used for the active noise control, and stops outputting of the canceling sound when the number of abnormity detection times exceeds a prescribed value (refer to Document 1: JP 1998-187201 A).

Document 1 discloses the technique, when the disturbance sound is detected, to continue the processing of updating the filter coefficient while resetting the parameters such as the transfer function and the convergence coefficient to be used for the active noise control. As a result, the filter coefficient may diverge, depending on the disturbance sound, even when the parameters such as the transfer function and the convergence coefficient are reset while the update processing of the filter coefficient is continued. In addition, even though the filter coefficient does not diverge, the filter coefficient may be updated to a value adaptive to the disturbance sound that is not the sound to be silenced, and accordingly, it may cause to reduce the performance of silencing the noise, which is originally the sound to be silenced, for some time after the mixing of the disturbance sound has been lost.

SUMMARY OF INVENTION

It is an object of the present invention to provide a signal processing device, a program and a range hood system, which can suppress divergence of a filter coefficient, and a reduction in silencing performance caused by adaptation to disturbance sound, even when the disturbance sound is collected in active noise control.

A signal processing device according to an aspect of the present invention is to be used in combination with a sound input/output device. The sound input/output device includes a first sound inputter, a sound outputter and a second sound inputter. The first sound inputter is installed in an object space, where noise made by a noise source is propagated, to collect the noise. The sound outputter is configured to output a canceling sound for canceling the noise to the object space in response to receiving a canceling signal. The second sound inputter is configured to collect a synthesized sound of the noise and the canceling sound in the object space. The signal processing device includes a canceling signal generator, a correction filter, a coefficient updater, a disturbance detector and an updating stopper. The canceling signal generator includes a silencer filter with a filter coefficient, and is configured to output the canceling signal in response to receiving a first signal generated based on an output of the first sound inputter. The correction filter is configured to generate a second signal by correcting the first signal based on a transfer function of an acoustic path from the sound outputter to the second sound inputter. The coefficient updater is configured to calculate the filter coefficient based on the second signal and a third signal generated from an output of the second sound inputter, and update the filter coefficient of the silencer filter. The disturbance detector is configured to detect mixing of disturbance sound, different from each of the noise and the canceling sound, to at least one of the output of the first sound inputter and the output of the second sound inputter. The updating stopper is configured to, when the disturbance detector detects the mixing of the disturbance sound, cause the coefficient updater to stop a processing of updating the filter coefficient, relating to at least a frequency band other than a frequency band of the noise.

A program according to an aspect of the present invention is to be stored in a computer that is used in combination with a sound input/output device. The sound input/output device includes a first sound inputter, a sound outputter and a second sound inputter. The first sound inputter is installed in an object space, where noise made by a noise source is propagated, to collect the noise. The sound outputter is configured to output a canceling sound for canceling the noise to the object space in response to receiving a canceling signal. The second sound inputter is configured to collect a synthesized sound of the noise and the canceling sound in the object space. The program causes the computer to realize: a function to constitute a silencer filter with a filter coefficient, and output the canceling signal in response to receiving a first signal generated based on an output of the first sound inputter; a function to generate a second signal by correcting the first signal based on a transfer function of an acoustic path from the sound outputter to the second sound inputter; a function to calculate the filter coefficient based on the second signal and a third signal generated from an output of the second sound inputter, and update the filter coefficient of the silencer filter; a function to detect mixing of disturbance sound, different from each of the noise and the canceling sound, to at least one of the output of the first sound inputter and the output of the second sound inputter; and a function to, when the mixing of the disturbance sound is detected, stop a processing of updating the filter coefficient, relating to at least a frequency band other than a frequency band of the noise. Note that, a medium that provides the program may be a computer-readable recording medium.

A range hood system according to an aspect of the present invention includes a ventilation passage, an air blower, a first sound inputter, a sound outputter, a second sound inputter and a signal processing device. The ventilation passage has a hollow tubular shape. The air blower is configured to generate air flow from a first end of the ventilation passage to a second end of the ventilation passage. The first sound inputter is installed in the ventilation passage to collect noise made by the air blower. The sound outputter is configured to output a canceling sound for canceling the noise to the ventilation passage in response to receiving a canceling signal. The second sound inputter is configured to collect a synthesized sound of the noise and the canceling sound in the ventilation passage. The signal processing device is configured to generate the canceling signal. The signal processing device includes a canceling signal generator, a correction filter, a coefficient updater, a disturbance detector and an updating stopper. The canceling signal generator includes a silencer filter with a filter coefficient, and is configured to output the canceling signal in response to receiving a first signal generated based on an output of the first sound inputter. The correction filter is configured to generate a second signal by correcting the first signal based on a transfer function of an acoustic path from the sound outputter to the second sound inputter. The coefficient updater is configured to calculate the filter coefficient based on the second signal and a third signal generated from an output of the second sound inputter, and update the filter coefficient of the silencer filter. The disturbance detector is configured to detect mixing of disturbance sound, different from each of the noise and the canceling sound, to at least one of the output of the first sound inputter and the output of the second sound inputter. The updating stopper is configured to, when the disturbance detector detects the mixing of the disturbance sound, cause the coefficient updater to stop a processing of updating the filter coefficient, relating to at least a frequency band other than a frequency band of the noise.

In the signal processing device, the program and the range hood system according to the aspects of the present invention, when the mixing of the disturbance sound is detected, the processing of updating the filter coefficient of the silencer filter is stopped, as described above. Therefore, when the mixing of the disturbance sound is detected, the silencer filter maintains the filter coefficient that has been set before the occurrence of the disturbance sound, and it is accordingly possible to suppress divergence of the filter coefficient, and a reduction in the silencing performance caused by adaptation to the disturbance sound. That is, an effect is provided in which, even when the disturbance sound is collected in active noise control, it is possible to suppress divergence of the filter coefficient, and a reduction in the silencing performance caused by adaptation to the disturbance sound.

DESCRIPTION OF EMBODIMENTS (Embodiment 1)

Figure 1:
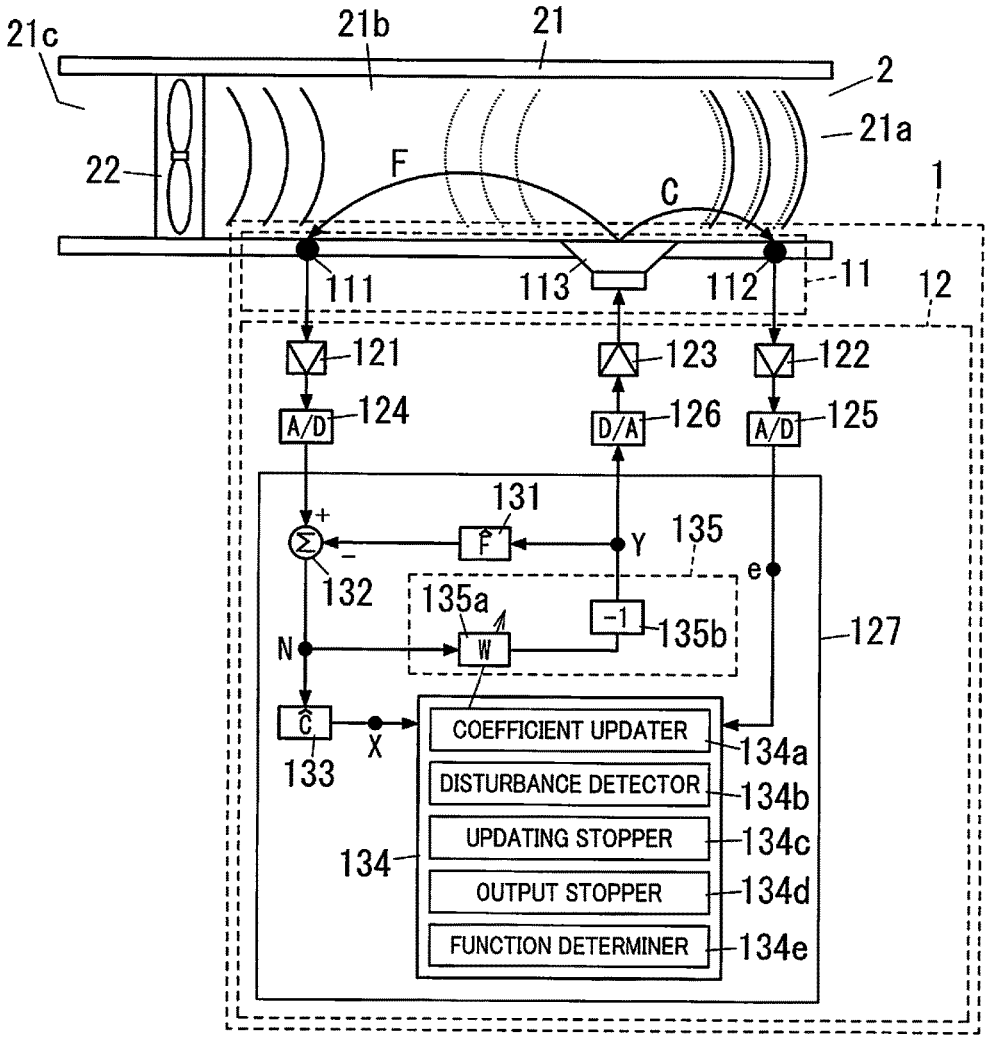
FIG. 1 is a diagram illustrating an exemplary configuration of a range hood system according to Embodiment 1.

FIG. 1 shows an exemplary configuration of a range hood system 2 into which a silencer 1 (active noise control device) is incorporated.

Figure 2:
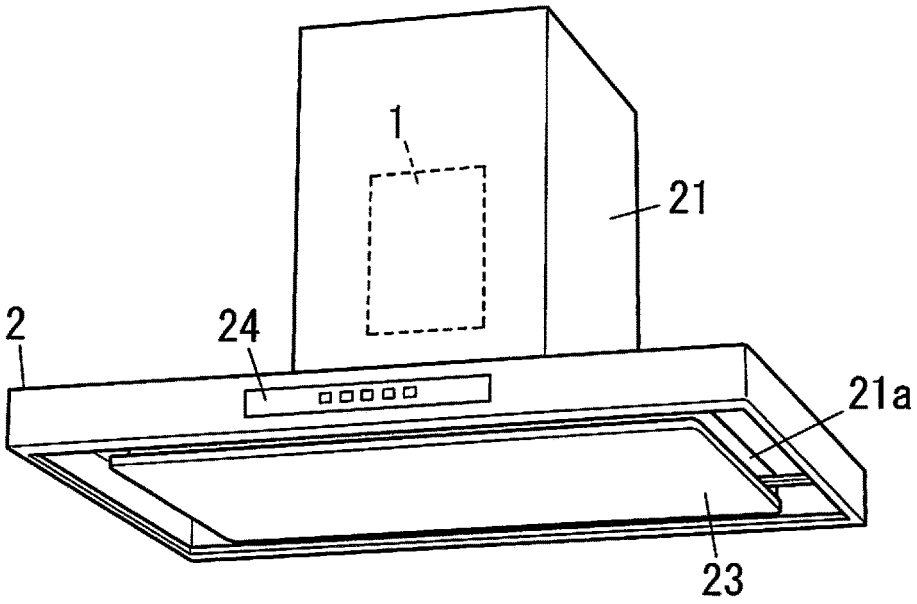
FIG. 2 is a perspective view of an appearance of the range hood system according to Embodiment 1.

The range hood system 2, as shown in FIG. 2, includes a hood 21 (ventilation passage) disposed above a kitchen utensil in a kitchen. The hood 21 has a box-shape, and is provided in a bottom surface thereof with an intake port 21*a*. The hood 21 includes therein a fan 22 (refer to FIG. 1) for taking the indoor air into the hood 21 from the indoor through the intake port 21*a*, and exhausting the indoor air to the outdoor. In other words, a space within the hood 21 corresponds to the ventilation passage, and the fan 22 generates in the ventilation passage air flow from the intake port 21*a* of the hood 21 to an exhaust port 21*c* (refer to FIG. 1).

The range hood system 2 further includes a straightening plate 23. The intake port 21*a* is formed around the straightening plate 23. The straightening plate 23 has a function to improve intake efficiency. The range hood system 2 is provided at a front surface thereof with an operation portion 24. The operation portion 24 includes operational switches for various operations of the range hood system 2, an indication lamp for indicating an operation state, and the like.

While the fan 22 is operating, the operation sound of the fan 22 is propagated in the ventilation passage, and then transmitted into the indoor through the intake port 21*a*. That is, the fan 22 is a noise source, and the noise is propagated into the indoor through the space within the hood 21. In other words, execution of silencing in the space within the hood 21 can reduce the noise that is propagated from the noise source to the intake port 21*a*. In this embodiment, the silencer 1 is installed in order to suppress the noise from being transmitted into the indoor while the fan 22 is operating. Hereinafter, the space within the hood 21, which is an object to be silenced, is referred to as an "object space". The object space is denoted by a reference sign "21*b*".

The silencer 1, as shown in FIG. 1, includes an sound input/output device 11 and a silencing circuit 12.

The sound input/output device 11 includes a referring microphone 111 (first sound inputter), an error microphone 112 (second sound inputter), and a speaker 113 (sound outputter). The referring microphone 111 is disposed on the side of the fan 22 in the hood 21. The error microphone 112 is disposed on the side of the intake port 21*a* in the hood 21. The speaker 113 is disposed between the referring microphone 111 and the error microphone 112 in the object space 21*b*. That is, the referring microphone 111, the speaker 113 and the error microphone 112 are arranged in that order in a path from the fan 22 as the noise source to the intake port 21*a*.

The silencing circuit 12 includes amplifiers 121, 122 and 123, A/D converters 124 and 125, a D/A converter 126 and a signal processing device 127.

An analog signal output from the referring microphone 111 is amplified by the amplifier 121, and then subjected to an Analog-Digital conversion by the A/D converter 124. A digital signal output from the A/D converter 124 is input to the signal processing device 127. On the other hand, an analog signal output from the error microphone 112 is amplified by the amplifier 122, and then subjected to an Analog-Digital conversion by the A/D converter 125. A digital signal output from the A/D converter 125 is input to the signal processing device 127.

The signal processing device 127 is configured by a computer that executes a program. The signal processing device 127 defines to a "silencing point" a position where the error microphone 112 is disposed, and causes the speaker 113 to output a canceling sound for canceling the noise made by the fan 22 such that a sound pressure level at the silencing point is minimized. That is, the signal processing device 127 outputs a canceling signal that is a digital signal. This canceling signal is subjected to a Digital-Analog conversion by the D/A converter 126, and then amplified by the amplifier 123. The speaker 113 is then driven by the canceling signal that is an analog signal output from the amplifier 123, and accordingly outputs a canceling sound.

The speaker 113 outputs the canceling sound, thereby suppressing the noise that transmits from the fan 22 to the outside of the hood 21 through the intake port 21*a*. The signal processing device 127 performs active noise control, and has a function of an adaptive filter in order to follow up a change in the noise made by the fan 22 as the noise source or a change in the noise propagation characteristics.

The signal processing device 127 includes a device of operating according to a program, which may be selected from DSP (Digital Signal Processor), CPU (Central Processing Unit), MPU (Micro-Processing Unit) and the like. A filter coefficient of the adaptive filter is updated using a sequential update control algorithm referred to as Filtered-X LMS (Least Mean Square).

Hereinafter, operation of the silencing circuit 12 will be described.

The referring microphone 111 outputs a reference signal, obtained by converting sound including the noise made by the fan 22 into an electrical signal. The signal processing device 127 receives the reference signal, which is a digital signal, through the amplifier 121 and the A/D converter 124. Here the A/D converter 124 performs an Analog-Digital conversion with a predetermined sampling frequency to the reference signal amplified by the amplifier 121, and outputs the reference signal, which is a digital signal, to the signal processing device 127.

The error microphone 112 outputs an error signal obtained by converting, into an electrical signal, sound including residual noise, which is remained without being canceled at the silencing point by the canceling sound. The signal processing device 127 receives the error signal e, which is a digital signal, through the amplifier 122 and the A/D converter 125. Here the A/D converter 125 performs an Analog-Digital conversion with the same sampling frequency as the A/D converter 124 to the error signal amplified by the amplifier 122, and outputs the error signal e (third signal), which is a digital signal, to the signal processing device 127.

The signal processing device 127 includes a howling cancel filter 131, a subtractor 132, a correction filter 133, a controller 134 and a canceling signal generator 135. The controller 134 includes a coefficient updater 134*a*, a disturbance detector 134*b*, an updating stopper 134*c*, an output stopper 134*d* and a function determiner 134*e*. The canceling signal generator 135 includes a silencer filter 135*a* and a phase inverter 135*b*.

The howling cancel filter 131 is a FIR (Finite Impulse Response) filter in which a transfer function F^ is set as a filter coefficient. The transfer function F^ is obtained by simulating a transfer function F of a sound wave from the speaker 113 to the referring microphone 111. In this embodiment, a sign with the symbol "^" (i.e., ^ symbol) (for example, a sign "F^" with respect to a sign "F") corresponds to a sign having a hat symbol thereabove, shown in the figures. A sign having the hat symbol represents a transfer function obtained by simulating a transfer function represented by a sign not having the hat symbol. For example, a sign "F^" represents a transfer function obtained by simulating a transfer function F.

The howling cancel filter 131 subjects the canceling signal Y output from the canceling signal generator 135 and the transfer function F^ to convolution calculation. The subtractor 132 outputs a signal obtained by subtracting an output of the howling cancel filter 131 from the reference signal, output from the A/D converter 124. That is, the subtractor 132 subtracts a wraparound component of the canceling sound from the noise signal, output from the referring microphone 111, and accordingly, outputs a noise signal N (first signal) obtained by extracting a noise component made by the fan 22. By this processing, it is possible to prevent occurrence of howling, even if the canceling sound emitted from the speaker 113 sneaks to the referring microphone 111. The noise signal N from the subtractor 132 is input to both of the correction filter 133 and the silencer filter 135*a* of the canceling signal generator 135.

The correction filter 133 and the silencer filter 135*a* are a FIR type of adaptive filter. A filter coefficient of the correction filter 133 is set so as to be identical to a transfer function C^ obtained by simulating a transfer function C of a sound wave from the speaker 113 to the error microphone 112. The correction filter 133 subjects the noise signal N output from the subtractor 132 and the transfer function C^ to convolution calculation. An output of the correction filter 133 is input to the controller 134. The output of the correction filter 133 is referred to as a correction signal X (second signal).

The coefficient updater 134*a* of the controller 134 updates a filter coefficient of the silencer filter 135*a*, using a well-known sequential update control algorithm referred to as Filtered-X LMS. The coefficient updater 134*a* calculates the filter coefficient of the silencer filter 135*a*, based on the correction signal X from the correction filter 133 and the error signal e from the A/D converter 125. The silencer filter 135*a* of this embodiment uses a single filter coefficient common to a whole frequency band of the canceling sound.

Generally in a processing of updating a filter coefficient, using Filtered-X LMS, the filter coefficient is updated such that the error signal e is minimized. In this case, a cost function J is defined by MATHEMATICAL 1 below. In MATHEMATICAL 1, "E" denotes an expected value (long time average), and "n" denotes a sampling number that corresponds to an order for an update timing.

$$J=E[e^2(n)] \quad \text{[MATHEMATICAL 1]}$$

This cost function J is expressed by MATHEMATICAL 2 below based on a steepest descent algorithm.

$$\begin{aligned} W(n+1) &= W(n) - \mu\frac{\partial J}{\partial W}(n) \\ &= W(n) - 2E[x(n)e(n)] \end{aligned} \quad \text{[MATHEMATICAL 2]}$$

Figure 3:
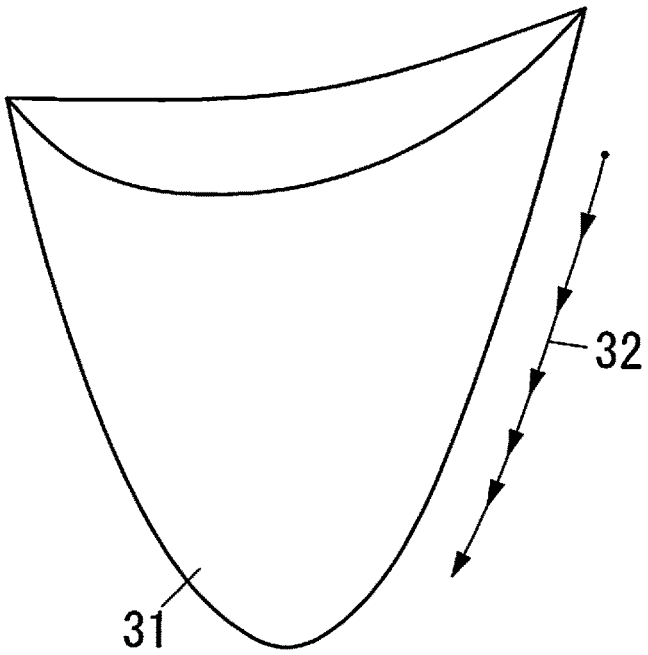
FIG. 3 is an explanatory diagram illustrating an error curved surface of a steepest descent algorithm according to Embodiment 1.

Since an error curved surface 31 of the steepest descent algorithm is represented by a quadric surface as shown in FIG. 3, the least square error is reached by updating a filter coefficient such that its slope is in a negative direction, and the filter coefficient therefore converges. In FIG. 3, arrows 32 schematically represent that an error converges toward a minimum value at each of update timings. Each arrow 32 shows a change in the error for each of the update timings. In MATHEMATICAL 2, "W", "μ" and "X" denote a filter coefficient, an update parameter and a reference signal, respectively. More specifically, the processing of updating the filter coefficient of the silencer filter 135*a* is expressed by MATHEMATICAL 3 below.

$$W(n+1)=W(n)-2\mu X(n)e(n) \quad \text{[MATHEMATICAL 3]}$$

When a difference between a filter coefficient W(n) and a filter coefficient W(n+1) is reduced to a prescribed reference value or less while the calculation of MATHEMATICAL 3 is repeated for each update timing, the coefficient updater 134*a* determines that the filter coefficient has converged. Generally when a second term of the right side, including the correction signal X, the error signal e and the update parameter μ, is increased, the filter coefficient converges at a faster speed. In other words, a convergence speed of the filter coefficient W depends on sizes of the correction signal X, the error signal e and the update parameter μ.

For example if amplitude of at least one of the correction signal X and the error signal e is large, the filter coefficient W converges fast. On the other hand, if amplitude of the correction signal X and amplitude of the error signal e are small, a long time is taken for that the filter coefficient W converges.

The coefficient updater 134*a* of this embodiment adjusts the convergence speed of the filter coefficient W by multiplying a product of the correction signal X and the error signal e by the update parameter μ. When the update parameter μ is made increased, the time taken for the convergence is decreased. When the update parameter μ is too large, however, there is a possibility that the filter coefficient W does not converge. Accordingly, the coefficient updater 134*a* sets the update parameter μ having an appropriate size in a range where the filter coefficient W can converge.

The coefficient updater 134*a* updates the filter coefficient W of the silencer filter 135*a* by every sampling period. The silencer filter 135*a* subjects the noise signal N and the filter coefficient W to convolution calculation, and outputs this calculation result. An output of the silencer filter 135*a* is phase-inverted by the phase inverter 135*b*, and the canceling signal Y is therefore generated. The canceling signal Y output from the canceling signal generator 135 is subjected to a Digital-Analog conversion by the D/A converter 126, and then amplified by the amplifier 123. The canceling signal output from the amplifier 123 is input to the speaker 113, and the canceling sound is therefore emitted by the speaker 113.

The canceling signal Y is generated such that a waveform thereof have a reverse phase and same amplitude with respect to a waveform of the noise at the silencing point. The canceling sound is emitted from the speaker 113 based on the canceling signal Y, thereby reducing the noise that is propagated in the object space 21*b* from the fan 22 and emitted through the intake port 21*a*.

Next, a processing upon occurrence of the disturbance sound will be described.

The disturbance sound may often occur by a disturbance around the range hood system 2, and the referring microphone 111 and the error microphone 112 accordingly may collect the disturbance sound. The disturbance sound collected by the referring microphone 111 is mixed in an output of the referring microphone 111. Similarly, the disturbance sound collected by the error microphone 112 is mixed in an output of the error microphone 112. That is, there is a possibility that a component of the disturbance sound is mixed in the correction signal X and the error signal e. In addition, if the disturbance sound is mixed in as least one of the correction signal X and the error signal e, the filter coefficient W may diverge in the processing by the coefficient updater 134*a*. Note that, the disturbance sound corresponds to sound made by a cooking stove, a water flow of a sink or the like, installed below the range hood system 2, and it is different from the noise made by the fan 22 and the canceling sound output from the speaker 113.

The controller 134 includes the disturbance detector 134*b*. The disturbance detector 134*b* is configured to detect whether the disturbance sound is mixed. More specifically, the disturbance detector 134*b* determines that mixing of the disturbance sound to the correction signal X is present, when amplitude of a temporal waveform of the correction signal X exceeds a prescribed first threshold. In addition, the disturbance detector 134*b* determines that mixing of the disturbance sound to the error signal e is present, when amplitude of a temporal waveform of the error signal e exceeds a prescribed second threshold. In other words, the disturbance detector 134*b* detects the mixing of the disturbance sound, when amplitude of a temporal waveform of any one of the correction signal X and the error signal e exceeds a predetermined threshold (the first threshold or the second threshold). Hereinafter, "amplitude of a temporal waveform" is simply referred to as "amplitude".

The disturbance detector 134*b* may be configured to detect the mixing of the disturbance sound, when the amplitude of the correction signal X exceeds the first threshold and further the amplitude of the error signal e exceeds the second threshold.

The value of the first threshold is previously set based on the amplitude of the correction signal X generated from an output of the referring microphone 111, when the disturbance sound is absent while the noise by the fan 22 is present. More specifically, the disturbance detector 134*b* calculates a probability distribution (the average, the variance) of an amplitude peak based on the temporal waveform of the correction signal X, and sets the first threshold to a value, which the amplitude cannot probabilistically exceed when the disturbance sound is absent, based on this probability distribution.

The value of the second threshold is previously set based on the amplitude of the error signal e generated from an output of the error microphone 112, when the disturbance sound is absent while the noise by the fan 22 is present. More specifically, the disturbance detector 134*b* calculates a probability distribution (the average, the variance) of an amplitude peak based on the temporal waveform of the error signal e, and sets the second threshold to a value, which the amplitude cannot probabilistically exceed when the disturbance sound is absent, based on this probability distribution.

As described above, the disturbance detector 134*b* can detect mixing of the disturbance sound, based on amplitude of a temporal waveform of a signal generated from at least one of outputs of the referring microphone 111 and the error microphone 112. With this configuration, it is possible to relatively simplify calculation for detecting the mixing of the disturbance sound.

The controller 134 further includes the updating stopper 134*c*. The updating stopper 134*c* is configured to, when the disturbance detector 134*b* detects the mixing of the disturbance sound, cause the coefficient updater 134*a* to stop the processing of updating the filter coefficient W. A time period, during which the processing of updating the filter coefficient W is stopped by the updating stopper 134*c*, corresponds to a time period during which the disturbance detector 134*b* detects the mixing of the disturbance sound. However, the time period, during which the processing of updating the filter coefficient W is stopped by the updating stopper 134*c*, may further include a fixed time period from a time point at which a detected state of mixing of the disturbance sound is changed to a non-detected state, in addition to the time period during which the disturbance detector 134*b* detects the mixing of the disturbance sound. When the stop of the updating processing for the filter coefficient W, by the updating stopper 134*c*, is released, the coefficient updater 134*a* restarts the updating processing for the filter coefficient W.

As described above, the signal processing device 127 stops the updating processing for the filter coefficient W of the silencer filter 135*a* in response to detecting the mixing of the disturbance sound. Accordingly, the silencer filter 135*a* maintains the filter coefficient W, which has been set before the occurrence of the disturbance sound, at a time point of detecting the mixing of the disturbance sound, and it is therefore possible to suppress divergence of the filter coefficient W. In other words, the signal processing device 127 can suppress the divergence of the filter coefficient W, and a reduction in the silencing performance caused by adaptation to the disturbance sound, even when the disturbance sound is collected in the active noise control. Furthermore, the program to be executed by the signal processing device 127 and the range hood system 2 with the silencing circuit 12 can also provide the above-mentioned same effect.

The output stopper 134*d* of the controller 134 monitors an output of the silencer filter 135*a* (i.e., a signal that is inverted to make the canceling signal Y), and stops the output of the silencer filter 135*a* when an output value of the silencer filter 135*a* exceeds a prescribed threshold. The output value of the silencer filter 135*a* is treated as a variable in the program to be executed by the signal processing device 127. This variable has a permissible range (an upper limit and a lower limit) as shown in TABLE 1 below.

TABLE 1

| Input Voltage (V) of Amplifier 123 | Variable (Code) | |
|---|---|---|
| +V1 | +aaaaa | Upper Limit |
| +V2 | +bbbbb | |
| 0 | 00000 | |
| −V2 | −bbbbb | |
| −V1 | −aaaaa | Lower Limit |

If the output value of the silencer filter 135*a* is out of the permissible range, there is a case where the filter coefficient W diverges due to that the speaker 113 emits the canceling sound at large volume or the system causes malfunction. To solve this, as described above, when a volume of the canceling sound output by the speaker 113 exceeds a prescribed volume, outputting of the canceling sound by the speaker 113 is stopped. As a result, the filter coefficient W is prevented from diverging.

Figure 4:
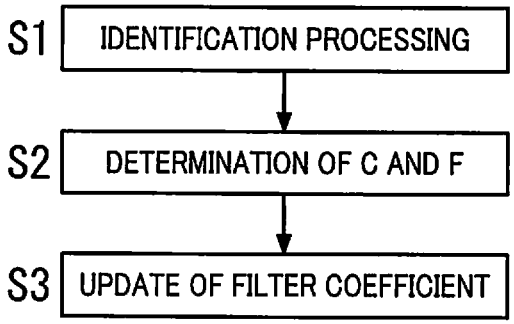
FIG. 4 is a flowchart illustrating a relationship between an identification processing and an update processing according to Embodiment 1.

Next, an identification processing for the transfer functions C and F to be performed by the function determiner 134*e* will be described. FIG. 4 shows a relationship between the identification processing for the transfer functions C and F and the processing of updating the filter coefficient W. The function determiner 134*e* performs the identification processing for the transfer functions C and F (Step S1), and then determines the transfer functions C and F (Step S2). The filter coefficient of the correction filter 133 is then set with the transfer function C determined by the function determiner 134*e*. Also, the filter coefficient of the howling cancel filter 131 is set with the transfer function F determined by the function determiner 134*e*. After that, the coefficient updater 134*a* performs the processing of updating the filter coefficient W described above (Step S3). The identification processing for the transfer functions C and F may be performed at the factory shipment, after the site construction, or the like.

Figure 5:
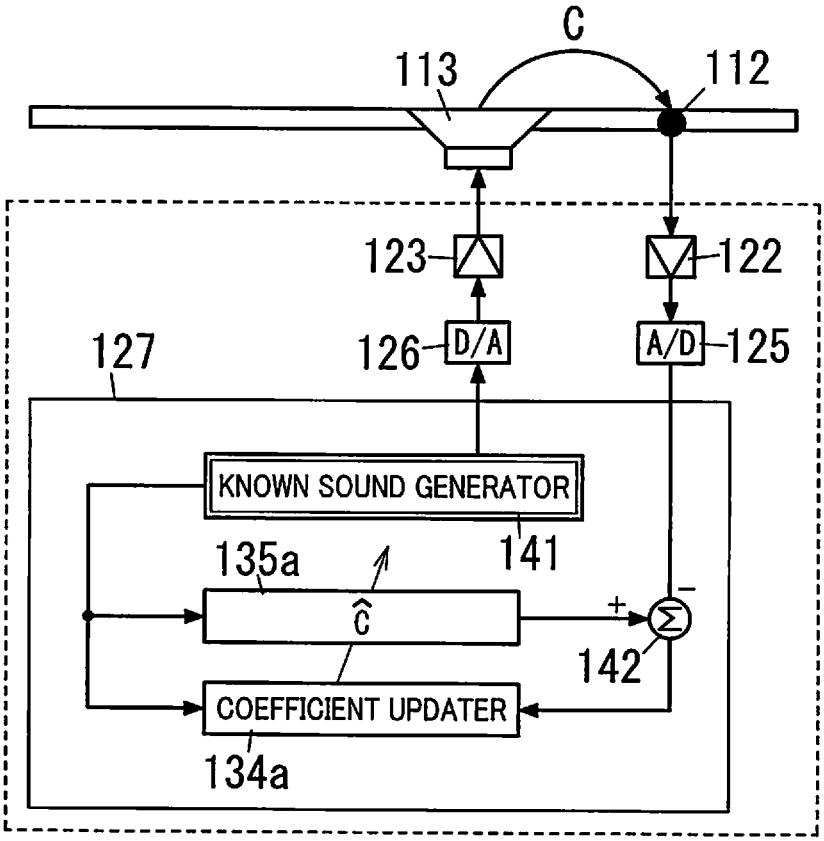
FIG. 5 is a schematic block diagram illustrating an identification processing for a transfer function according to Embodiment 1.

FIG. 5 schematically shows the identification processing for the transfer function C by the function determiner 134*e*. Note that, functions of a known sound generator 141 and a subtractor 142 in FIG. 5 may be also realized by a program being executed by the device that constitutes the signal processing device 127.

The signal processing device 127 includes the known sound generator 141 that outputs, as a known signal, a signal including white noise (a white noise signal). The function determiner 134*e* (refer to FIG. 1) inputs the white noise signal of the known sound generator 141 to the D/A converter 126, and gives an output of the D/A converter 126 to the speaker 113 via the amplifier 123 to output the white noise from the speaker 113. The white noise output from the speaker 113 is collected by the error microphone 112, and accordingly, the error microphone 112 outputs a known sound signal (fourth signal). The known sound signal is input to the subtractor 142 via the amplifier 122 and the A/D converter 125.

The white noise signal of the known sound generator 141 is also input to the silencer filter 135*a* and the coefficient updater 134*a*. The subtractor 142 outputs a signal, obtained by subtracting the known sound signal from an output of the silencer filter 135*a*, to the coefficient updater 134*a*. The coefficient updater 134*a* updates the filter coefficient of the silencer filter 135*a* such that an output of the subtractor 142 is minimized. The filter coefficient in the silencer filter 135*a*, at when the filter coefficient has converged by this update processing, is the transfer function C determined by the function determiner 134*e*.

That is, the coefficient updater 134*a* updates the filter coefficient of the silencer filter 135*a* such that a difference is minimized, the difference being between: the known sound signal generated based on an output of the error microphone 112; and a signal obtained by making the white noise signal as the known signal pass through the silencer filter 135*a*. The coefficient updater 134*a* repeatedly updates the filter coefficient, and accordingly, the filter coefficient of the silencer filter 135*a* can be made to be closer to a truth transfer function.

When the disturbance detector 134*b* detects mixing of the disturbance sound to the output of the error microphone 112 while the function determiner 134*e* performing the identification processing for the transfer function C, the updating stopper 134*c* causes the coefficient updater 134*a* to stop the processing of updating the filter coefficient of the silencer filter 135*a*. By this stop processing, it is possible to suppress the filter coefficient from diverging during the identification processing for the transfer function C by the function determiner 134*e*. When the stop of the update processing for the filter coefficient, by the updating stopper 134*c*, is then released, the coefficient updater 134*a* restarts the updating processing for the filter coefficient. As described above, the function determiner 134*e* can calculate the transfer function C with higher accuracy, even when the disturbance sound is present, and accordingly, it is possible to obtain high silencing performance.

Similarly to the determination processing for the transfer function C described above, the function determiner 134*e* also performs a determination processing for the transfer function F, using an output of the referring microphone 111 that has collected the white noise. When the disturbance detector 134*b* detects mixing of the disturbance sound to the output of the referring microphone 111 while the function determiner 134*e* performing the identification processing for the transfer function F, the coefficient updater 134*a* stops the processing of updating the filter coefficient of the silencer filter 135*a*. Therefore, it is possible to suppress the filter coefficient from diverging during the identification processing for the transfer function F by the function determiner 134*e*. When the stop of the update processing for the filter coefficient, by the updating stopper 134*c*, is then released, the coefficient updater 134*a* restarts the updating processing for the filter coefficient. As described above, the function determiner 134*e* can calculate the transfer function F with higher accuracy, even when the disturbance sound is present, and accordingly, it is possible to obtain high silencing performance.

Figure 6:
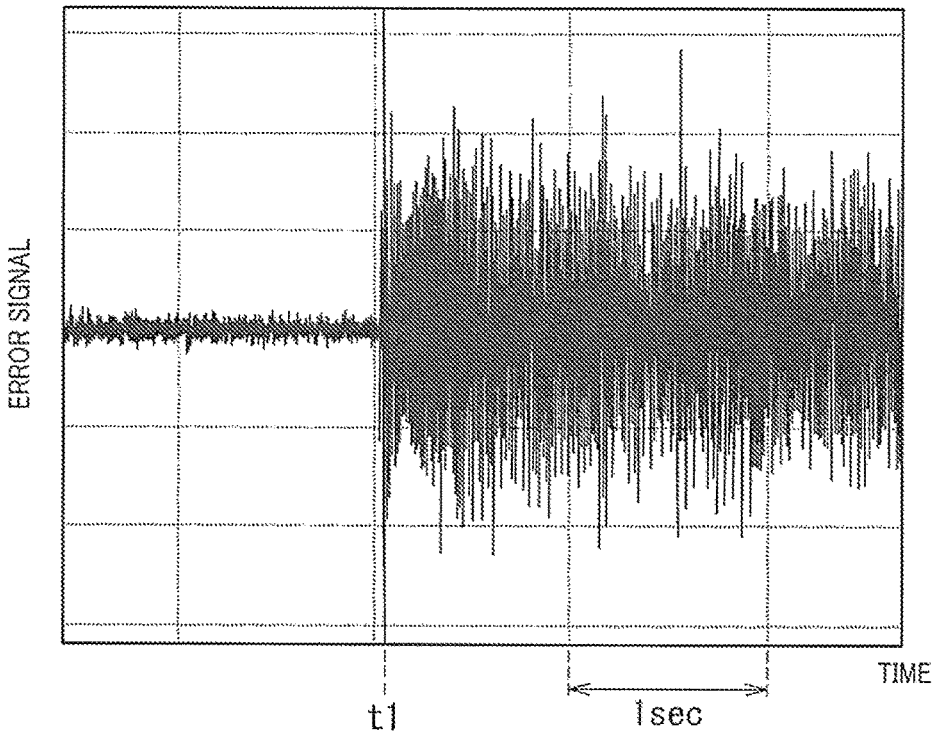
FIG. 6 is a waveform diagram illustrating a silencing effect in case a disturbance detector is not made operated, according to Embodiment 1.

FIG. 6 shows a temporal waveform of the error signal output by the error microphone 112 in case the disturbance detector 134*b* is not made operated. In the case of FIG. 6, the disturbance sound (impulsive sound) occurs at a time t1. In the exemplary operation of FIG. 6, the update processing for the filter coefficient W is continued without operating the disturbance detector 134*b*. For this reason, the filter coefficient W diverges due to the disturbance sound after the time t1 and the amplitude of the error signal is increased by the silencing effect being deteriorated.

Figure 7:
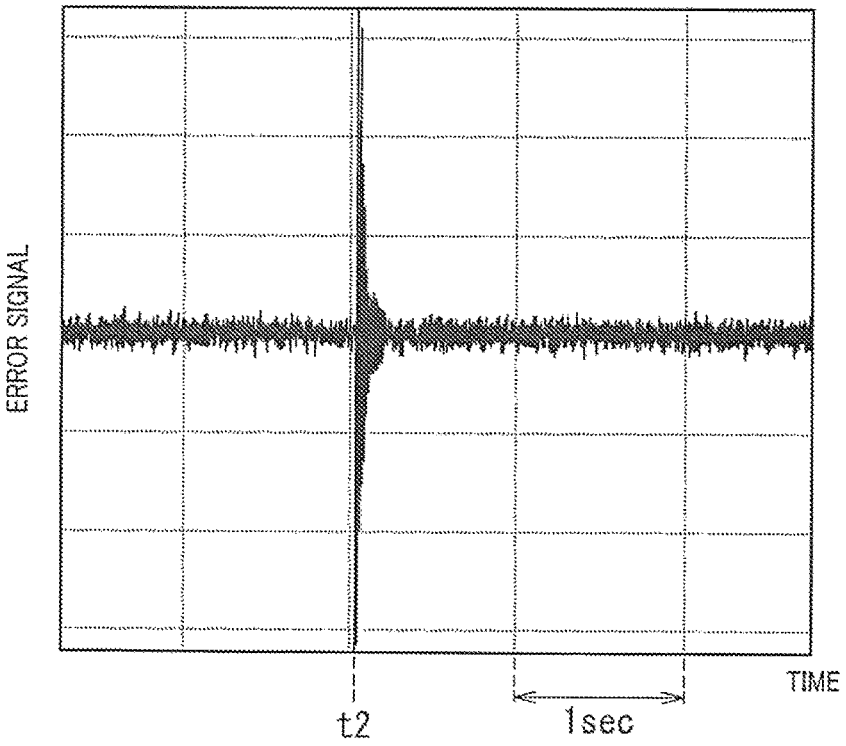
FIG. 7 is a waveform diagram illustrating a silencing effect in case the disturbance detector is made operated, according to Embodiment 1.

On the other hand, FIG. 7 shows a temporal waveform of the error signal output by the error microphone 112 in case the disturbance detector 134*b* is made operated. In the case of FIG. 7, the disturbance sound (impulsive sound) occurs at a time t2. In the exemplary operation of FIG. 7, the disturbance detector 134*b* detects the disturbance sound, and the filter coefficient W is therefore stopped to be updated. When the disturbance sound becomes absent, the update of the filter coefficient W is restarted. For this reason, the amplitude of the error signal is reduced by the noise being suppressed by the canceling sound after the time t2.

(Embodiment 2)

Figure 8:
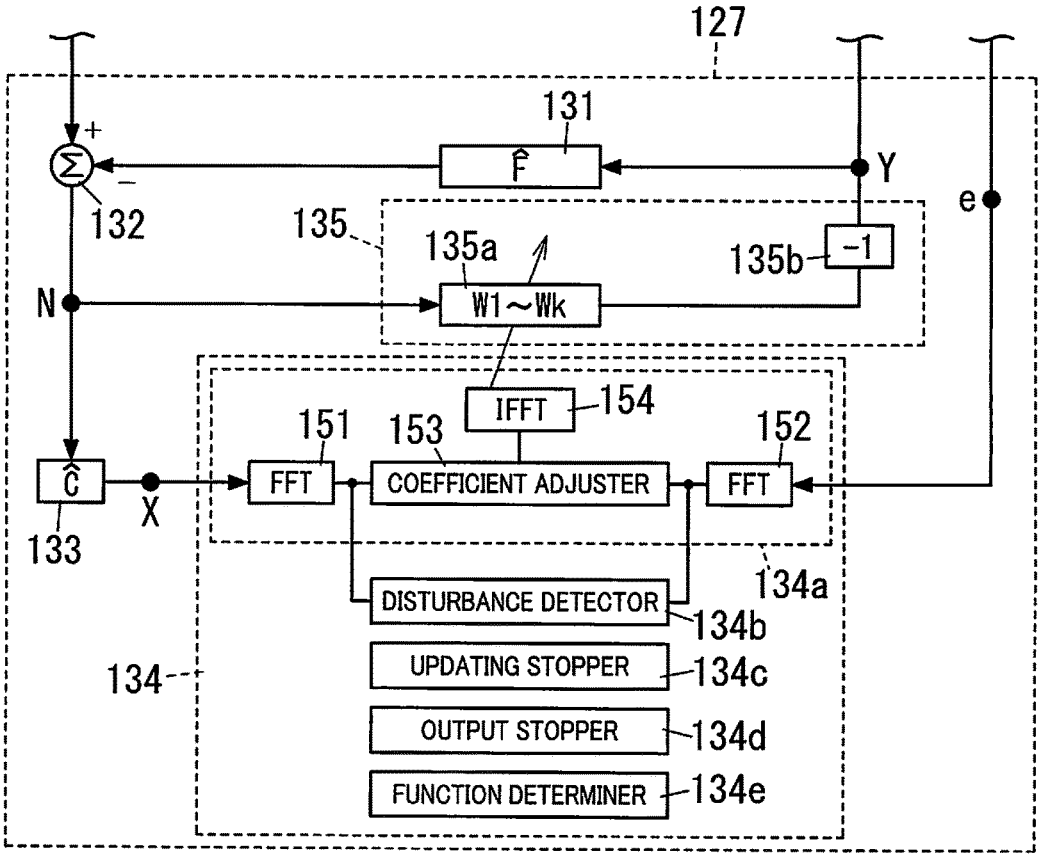
FIG. 8 is a block diagram illustrating part of a configuration according to Embodiment 2.

A controller 134 of a silencer 1 has a configuration as shown in FIG. 8. A silencer filter 135*a* of this embodiment has two or more filter coefficients W1 to Wk that respectively correspond to two or more frequency bins, into which a whole frequency band of a canceling sound is divided, the number of the frequency bins being "k". In addition, a coefficient updater 134*a* includes two frequency converters 151 and 152, a coefficient adjuster 153 and an inverse converter 154. Note that, because other elements are similar to those of Embodiment 1, such similar elements are denoted by same signs and explanations thereof are omitted.

The frequency converter 151 converts a correction signal X to a signal of a frequency domain by FFT (Fast Fourier Transform). The frequency converter 152 converts an error signal e to a signal of a frequency domain by FFT (Fast Fourier Transform).

The coefficient adjuster 153 receives the correction signal X of the frequency domain and the error signal e of the frequency domain. The coefficient adjuster 153 executes an algorithm of Filtered-X LMS in the frequency domain to set update parameters μ1 to μk that respectively correspond to the frequency bins, and calculates and outputs the filter coefficients W1 to Wk corresponding to the frequency bins of the silencer filter 135*a*. Furthermore, the coefficient adjuster 153 can adjust a convergence speed for each frequency bin, by setting the update parameters μ1 to μk corresponding to the frequency bins.

The inverse converter 154 executes IFFT (Inverse Fast Fourier Transform) to convert an output of the coefficient adjuster 153 to a signal of a time domain. The filter coefficients W1 to Wk corresponding to the frequency bins of the silencer filter 135*a* are set by an output of the inverse converter 154.

The coefficient updater 134*a* updates the filter coefficients W1 to Wk of the silencer filter 135*a* by every sampling period. The silencer filter 135*a* divides a noise signal N in units of the frequency bins, and subjects, in the units of the frequency bins, the noise signal N and the filter coefficients W1 to Wk to convolution calculation. The silencer filter 135*a* outputs the sum of results of the convolution calculation performed in the units of the frequency bins. Then an output of the silencer filter 135*a* is phase-inverted by a phase inverter 135*b*, thereby a canceling signal Y being generated. The canceling signal Y output from a canceling signal generator 135 is subjected to a Digital-Analog conversion by a D/A converter 126, and then amplified by an amplifier 123. An output of the amplifier 123 is input to a speaker 113, and the canceling sound is therefore emitted by the speaker 113.

The canceling sound (canceling signal Y) is generated such that a waveform thereof have a reverse phase and same amplitude with respect to a waveform of the noise at a silencing point, and reduces the noise that is propagated in a hood 21 from a fan 22 and emitted through an intake port 21*a*.

Next, a processing upon occurrence of disturbance sound will be described.

A disturbance detector 134*b* of this embodiment determines whether or not mixing of the disturbance sound is present, using the correction signal X of the frequency domain and the error signal e of the frequency domain. More specifically, a frequency distribution for the noise is previously analyzed, and the disturbance detector 134*b* previously stores data of frequency distributions for the correction signal X and the error signal e (noise distribution data) under a condition that the noise is present. Note that the noise distribution data may be data of frequency distributions for the correction signal X and the error signal e under a condition that both the noise signal and the canceling signal occur. That is, the noise distribution data can be said to be data representing the frequency distribution for the noise.

The disturbance detector 134*b* compares the frequency distribution for the correction signal X with the noise distribution data, and determines that mixing of the disturbance sound to the correction signal X is present, when the frequency distribution for the correction signal X is different from the noise distribution data. Also, the disturbance detector 134*b* compares the frequency distribution for the error signal e with the noise distribution data, and determines that mixing of the disturbance sound to the error signal e is present, when the frequency distribution for the error signal e is different from the noise distribution data. In short, the disturbance detector 134*b* detects mixing of the disturbance sound, when any one of the frequency distributions for the correction signal X and the error signal e is different from the noise distribution data.

For example, there is a possibility of adverse influence on a processing of updating a filter coefficient in case amplitude (a spectrum value) of a specific frequency component is increased due to the disturbance sound even if amplitude (an overall value) of the correction signal X or the error signal e is small. For this reason, it is to compare a frequency distribution for a signal generated based on at least one of outputs of a referring microphone 111 and an error microphone 112 with the frequency distribution for the noise. Accordingly, it is possible to improve detection accuracy for the disturbance sound by mixing of the disturbance sound being detected based on the frequency distribution.

Alternatively, the disturbance detector 134*b* may detect mixing of the disturbance sound, when both of the frequency distributions for the correction signal X and the error signal e are different from the noise distribution data.

An updating stopper 134*c* previously stores data of a frequency band of the noise that is made by the fan 22, which is an object to be silenced. Here the frequency band of the noise, which is the object to be silenced, may be different from a frequency band of the disturbance sound. For this reason, the updating stopper 134*c* is configured to, when the disturbance detector 134*b* detects the mixing of the disturbance sound, cause the coefficient updater 134*a* to stop a processing of updating the filter coefficient W, relating to only a frequency band(s) other than the frequency band of the noise. More specifically, when the mixing of the disturbance sound is detected, the updating stopper 134*c* causes the coefficient updater to stop the processing of updating the filter coefficient W, relating to, as an object, only a frequency bin(s), which does not correspond to the frequency band of the noise.

It is therefore possible to reduce a frequency of stopping the update of the filter coefficient W about the frequency band of the noise, and accordingly, it is possible to, regarding the frequency band of the noise, increase a convergence speed of the filter coefficient W, which is also related to the silencing performance. In addition, since the update of the filter coefficient W about the frequency band(s) other than the frequency band of the noise is stopped when the disturbance sound is detected, it is possible to suppress divergence of the filter coefficient W.

(Embodiment 3)

The disturbance detector 134*b* of Embodiment 1 or 2 specifies a direction where the sound source is positioned, based on an output of the referring microphone 111 and an output of the error microphone 112, and detects mixing of the disturbance sound based on the direction of the sound source. In other words, the disturbance detector 134*b* estimates the direction of the sound source that has made sound collected by the referring microphone 111 and the error microphone 112, and determines that the mixing of the disturbance sound is present, when the estimated direction of the sound source is different from an installation direction of the fan 22.

For example, the disturbance detector 134*b* obtains the direction of the sound source, as described below. To obtain the direction of the sound source, it is necessary to derive a time difference (arrival time difference) between times required for that sound waves emitted from the sound source enter the referring microphone 111 and the error microphone 112, respectively. This time difference may be calculated by a function of a correlation between the output of the referring microphone 111 and the output of the error microphone 112. When the obtained arrival time difference is multiplied by the speed of sound (about 340 m/s at normal temperature), a distance L1 as shown in FIG. 9 is obtained.

Figure 9:
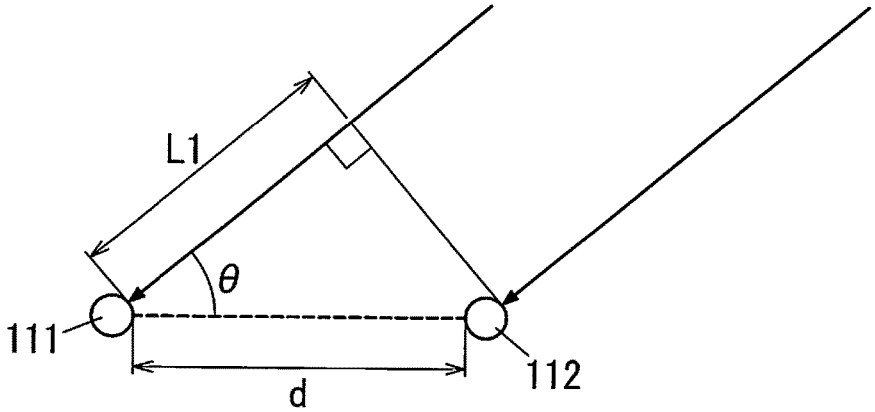
FIG. 9 is an explanatory diagram illustrating a processing of a disturbance detector according to Embodiment 3.

Also as shown in FIG. 9, a relationship of "the distance L1=d·sin θ" is met, where "d" denotes a distance between the referring microphone 111 and the error microphone 112, and "θ" denotes an angle that is formed by: a straight line connecting the referring microphone 111 and the error microphone 112; and the direction where the sound source is positioned. In this embodiment, the angle θ is defined as the direction of the sound source. Accordingly, the disturbance detector 134*b* can obtain the direction θ of the sound source by "the arrival time difference×the speed of sound=d·sin θ", thereby specifying the direction where the sound source is positioned.

Here a direction where the fan 22 as the noise source is positioned is known, and the fan 22 is positioned in a direction toward not the side of the error microphone 112 but the side of the referring microphone 111. The disturbance detector 134*b* stores data of a prescribed angle range, as the direction where the fan 22 is positioned, and determines that the sound source is the fan 22, when the direction θ of the sound source is within the angle range. On the other hand, the disturbance detector 134*b* determines that the sound source is a disturbance other than the fan when the direction θ of the sound source is out of the angle range, and detects mixing of the disturbance sound.

Here the direction of the sound source of this embodiment is added to a determination condition for detection of the disturbance sound to be performed by the disturbance detector 134*b* of Embodiment 1 or 2, and it is therefore possible to improve detection accuracy for the disturbance sound.

Note that, in each of the embodiments described above, the fan 22 of the range hood system 2 is cited as the noise source, however, the noise source is not limited to the fan 22. For example, the silencer 1 may be installed in a noise propagation path, such as a casing of an electrical apparatus, an air-conditioning duct or a tunnel, to suppress the noise propagating in the noise propagation path.

In each of the embodiments described above, a silencing circuit 12 is to be used in combination with a sound input/output device 11 that includes a referring microphone 111 (first sound inputter), an error microphone 112 (second sound inputter) and a speaker 113 (sound outputter). The referring microphone 111 is installed in a space, where noise made by a fan 22 (noise source) is propagated, to collect the noise. The speaker 113 is configured to output a canceling sound for canceling the noise to the space in response to receiving a canceling signal. The error microphone 112 is configured to collect a synthesized sound of the noise and the canceling sound in the space. The silencing circuit 12 includes a canceling signal generator 135, a correction filter 133, a coefficient updater 134*a*, a disturbance detector 134*b* and an updating stopper 134*c*.

The canceling signal generator 135 includes a silencer filter 135*a* with a filter coefficient, and is configured to output the canceling signal Y in response to receiving a noise signal N (first signal) generated based on an output of the referring microphone 111. The correction filter 133 is configured to generate a correction signal X (second signal) by correcting the noise signal N based on a transfer function C of an acoustic path from the speaker 113 to the error microphone 112.

The coefficient updater 134*a* is configured to calculate the filter coefficient based on the correction signal X and an error signal e (third signal) generated from an output of the error microphone 112, and update the filter coefficient of the silencer filter 135*a*. The disturbance detector 134*b* is configured to detect mixing of disturbance sound, different from each of the noise and the canceling sound, to at least one of the output of the referring microphone 111 and the output of the error microphone 112. The updating stopper 134*c* is configured to, when the disturbance detector 134*b* detects the mixing of the disturbance sound, cause the coefficient updater 134*a* to stop a processing of updating the filter coefficient, relating to at least a frequency band other than a frequency band of the noise.

A program that is executed by a signal processing device 127 is to be stored in a computer that is used in combination with a sound input/output device 11. The sound input/output device 11 includes a referring microphone 111 (first sound inputter), an error microphone 112 (second sound inputter) and a speaker 113 (sound outputter). The referring microphone 111 is installed in a space, where noise made by a fan 22 (noise source) is propagated, to collect the noise. The speaker 113 is configured to output a canceling sound for canceling the noise to the space in response to receiving a canceling signal. The error microphone 112 is configured to collect a synthesized sound of the noise and the canceling sound in the space. The program causes the computer to realize functions as follows:

[FUNCTION 1] to constitute a silencer filter 135*a* with a filter coefficient, and output the canceling signal Y in response to receiving a noise signal N (first signal) generated based on an output of the referring microphone 111;

[FUNCTION 2] to generate a correction signal X (second signal) by correcting the noise signal N based on a transfer function C of an acoustic path from the speaker 113 to the error microphone 112;

[FUNCTION 3] to calculate the filter coefficient based on the correction signal X and an error signal e (third signal) generated from an output of the error microphone 112, and update the filter coefficient of the silencer filter 135*a;*

[FUNCTION 4] to detect mixing of disturbance sound, different from each of the noise and the canceling sound, to at least one of the output of the referring microphone 111 and the output of the error microphone 112; and

[FUNCTION 5] to, when the mixing of the disturbance sound is detected, stop a processing of updating the filter coefficient, relating to at least a frequency band other than a frequency band of the noise.

This aspect of the present invention is not limited to the program, but may be a computer-readable recording medium that records the program.

A range hood system 2 includes a hood 21, a fan 22, a referring microphone 111 (first sound inputter), an error microphone 112 (second sound inputter), a speaker 113 (sound outputter) and a silencing circuit 12.

The hood 21 corresponds to a ventilation passage that has a hollow tubular shape. The fan 22 corresponds to an air blower that is configured to generate air flow from a first end of the hood 21 to a second end of the hood 21. The referring microphone 111 is installed in the hood 21 to collect noise made by the fan 22. The speaker 113 is configured to output a canceling sound for canceling the noise to the hood 21 in response to receiving a canceling signal. The error microphone 112 is configured to collect a synthesized sound of the noise and the canceling sound in the hood 21. The silencing circuit 12 is configured to generate the canceling signal.

The silencing circuit 12 includes a canceling signal generator 135, a correction filter 133, a coefficient updater 134*a*, a disturbance detector 134*b* and an updating stopper 134*c*.

The canceling signal generator 135 includes a silencer filter 135*a* with a filter coefficient, and is configured to output the canceling signal Y in response to receiving a noise signal N (first signal) generated based on an output of the referring microphone 111. The correction filter 133 is configured to generate a correction signal X (second signal) by correcting the noise signal N based on a transfer function C of an acoustic path from the speaker 113 to the error microphone 112.

The coefficient updater 134*a* that is configured to calculate the filter coefficient based on the correction signal X and an error signal e (third signal) generated from an output of the error microphone 112, and update the filter coefficient of the silencer filter 135*a*. The disturbance detector 134*b* is configured to detect mixing of disturbance sound, different from each of the noise and the canceling sound, to at least one of the output of the referring microphone 111 and the output of the error microphone 112. The updating stopper 134*c* is configured to, when the disturbance detector 134*b* detects the mixing of the disturbance sound, cause the coefficient updater 134*a* to stop a processing of updating the filter coefficient, relating to at least a frequency band other than a frequency band of the noise.

Note that, the embodiments described above are examples of the present invention. For this reason, the present invention is not limited to the embodiments described above, and various modifications can be made according to the design or the like even in a case other than the embodiments, as long as they do not depart from the technical ideas of the present invention.

The invention claimed is:

1. A signal processing device to be used in combination with a sound input/output device, the sound input/output device comprising:

a first sound inputter that is installed in a space, where noise made by a noise source is propagated, to collect the noise;

a sound outputter that is configured to output a canceling sound for canceling the noise to the space in response to receiving a canceling signal; and a second sound inputter that is configured to collect a synthesized sound of the noise and the canceling sound in the space, the signal processing device comprising:

a canceling signal generator that comprises a silencer filter with a filter coefficient, and is configured to output the canceling signal in response to receiving a first signal generated based on an output of the first sound inputter;

a correction filter that is configured to generate a second signal by correcting the first signal based on a transfer function of an acoustic path from the sound outputter to the second sound inputter;

a coefficient updater that is configured to calculate the filter coefficient based on the second signal and a third signal generated from an output of the second sound inputter, and update the filter coefficient of the silencer filter;

a disturbance detector that is configured to detect mixing of disturbance sound, different from each of the noise and the canceling sound, to at least one of the output of the first sound inputter and the output of the second sound inputter; and an updating stopper that is configured to, when the disturbance detector detects the mixing of the disturbance sound, cause the coefficient updater to stop a processing of updating the filter coefficient, relating to at least a frequency band other than a frequency band of the noise.

2. The signal processing device according to claim 1, wherein the updating stopper is configured to, when the disturbance detector detects the mixing of the disturbance sound, causes the coefficient updater to stop the processing of updating the filter coefficient, relating to, as an object, a whole frequency band of the canceling sound.

3. The signal processing device according to claim 1, wherein the updating stopper is configured to, when the disturbance detector detects the mixing of the disturbance sound, cause the coefficient updater to stop the processing of updating the filter coefficient, relating to only the frequency band other than the frequency band of the noise.

4. The signal processing device according to claim 3, wherein:

the silencer filter is configured to divide a prescribed frequency band into two or more frequency bins, and have the filter coefficient for each frequency bin; and the updating stopper is configured to, when the disturbance detector detects the mixing of the disturbance sound, cause the coefficient updater to stop the processing of updating the filter coefficient, relating to, as an object, only a frequency bin, which corresponds to the frequency band other than the frequency band of the noise, of the two or more frequency bins.

5. The signal processing device according to claim 1, wherein the disturbance detector that is configured to detect the mixing of the disturbance sound, when amplitude of a temporal waveform of a signal, generated based on at least one of the output of the first sound inputter and the output of the second sound inputter, exceeds a threshold based on amplitude of a temporal waveform of the noise.

6. The signal processing device according to claim 1, wherein the disturbance detector that is configured to:

compare a frequency distribution of a signal, generated based on at least one of the output of the first sound inputter and the output of the second sound inputter, with a frequency distribution of the noise; and detect the mixing of the disturbance sound based on a compared result.

7. The signal processing device according to claim 1, wherein the disturbance detector that is configured to:

derive a time difference based on a correlation between the output of the first sound inputter and the output of the second sound inputter, the time difference being a difference between a time required for that a sound made by a sound source reaches the first sound inputter and is collected by the first sound inputter and a time required for that the sound made by the sound source reaches the second sound inputter and is collected by the second sound inputter;

estimate a direction, where the sound source is positioned, based on the time difference; and detect the mixing of the disturbance sound, when the direction where the sound source is positioned is different from a direction where the noise source is positioned.

8. The signal processing device according to claim 1, causing the sound outputter to stop outputting of the canceling sound, when a volume of the canceling sound output by the sound outputter exceeds a prescribed volume.

9. The signal processing device according to claim 1, further comprising:

a known sound generator that is configured to input a known signal to the sound outputter so as to cause the sound outputter to output a known sound; and a function determiner that is configured to determine the transfer function, wherein:

the second sound inputter is configured to output a fourth signal in response to collecting the known sound;

the coefficient updater is configured to update the filter coefficient of the silencer filter such that a difference between the known signal passing through the silencer filter and the fourth signal is minimized;

the function determiner is configured to determine the transfer function based on the filter coefficient; and the updating stopper is configured to, when the disturbance detector detects the mixing of the disturbance sound, cause the coefficient updater to stop the processing of updating the filter coefficient.

10. A computer-readable, non-transitory, and tangible recording medium recording a program to be stored in a computer that is used in combination with a sound input/output device, the sound input/output device comprising:

a first sound inputter that is installed in a space, where noise made by a noise source is propagated, to collect the noise;

a sound outputter that is configured to output a canceling sound for canceling the noise to the space in response to receiving a canceling signal; and a second sound inputter that is configured to collect a synthesized sound of the noise and the canceling sound in the space, the program causing the computer to realize:

a function to constitute a silencer filter with a filter coefficient, and output the canceling signal in response to receiving a first signal generated based on an output of the first sound inputter;

a function to generate a second signal by correcting the first signal based on a transfer function of an acoustic path from the sound outputter to the second sound inputter;

a function to calculate the filter coefficient based on the second signal and a third signal generated from an output of the second sound inputter, and update the filter coefficient of the silencer filter;

a function to detect mixing of disturbance sound, different from each of the noise and the canceling sound, to at least one of the output of the first sound inputter and the output of the second sound inputter; and a function to, when the mixing of the disturbance sound is detected, stop a processing of updating the filter coefficient, relating to at least a frequency band other than a frequency band of the noise.

11. A range hood system, comprising:

a ventilation passage that has a hollow tubular shape;

an air blower that is configured to generate air flow from a first end of the ventilation passage to a second end of the ventilation passage;

a first sound inputter that is installed in the ventilation passage to collect noise made by the air blower;

a sound outputter that is configured to output a canceling sound for canceling the noise to the ventilation passage in response to receiving a canceling signal;

a second sound inputter that is configured to collect a synthesized sound of the noise and the canceling sound in the ventilation passage; and a signal processing device that is configured to generate the canceling signal, the signal processing device comprising:

a canceling signal generator that comprises a silencer filter with a filter coefficient, and is configured to output the canceling signal in response to receiving a first signal generated based on an output of the first sound inputter;

a correction filter that is configured to generate a second signal by correcting the first signal based on a transfer function of an acoustic path from the sound outputter to the second sound inputter;

a coefficient updater that is configured to calculate the filter coefficient based on the second signal and a third signal generated from an output of the second sound inputter, and update the filter coefficient of the silencer filter;

a disturbance detector that is configured to detect mixing of disturbance sound, different from each of the noise and the canceling sound, to at least one of the output of the first sound inputter and the output of the second sound inputter; and an updating stopper that is configured to, when the disturbance detector detects the mixing of the disturbance sound, cause the coefficient updater to stop a processing of updating the filter coefficient, relating to at least a frequency band other than a frequency band of the noise.

* * * * *